US006564711B1

(12) United States Patent
Meyer

(10) Patent No.: US 6,564,711 B1
(45) Date of Patent: May 20, 2003

(54) ULTRASONIC CLEANER AND TONER AGGLOMERATE DISPERSER FOR LIQUID INK DEVELOPMENT (LID) SYSTEMS USING SECOND SOUND

(75) Inventor: Robert J. Meyer, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 23 days.

(21) Appl. No.: 09/699,882

(22) Filed: Oct. 30, 2000

(51) Int. Cl.[7] ..... B41L 41/00
(52) U.S. Cl. ..... 101/423; 101/424; 399/349
(58) Field of Search ..... 101/424, 423, 101/425; 399/350, 349, 344, 348; 15/256.5, 256.51, 256.52

(56) References Cited

U.S. PATENT DOCUMENTS

| | | | | | |
|---|---|---|---|---|---|
| 3,964,386 | A | * | 6/1976 | Dini | 101/169 |
| 4,111,546 | A | * | 9/1978 | Maret | 134/1 |
| 4,281,434 | A | * | 8/1981 | Sullivan | 100/174 |
| 5,136,967 | A | * | 8/1992 | Sollinger et al. | 118/104 |
| 5,390,013 | A | * | 2/1995 | Snelling | 399/328 |
| 5,492,788 | A | | 2/1996 | Denton et al. | 430/137 |
| 5,517,291 | A | * | 5/1996 | Montfort et al. | 399/219 |
| 5,659,849 | A | * | 8/1997 | Lindblad et al. | 399/129 |
| 5,842,102 | A | * | 11/1998 | Montfort et al. | 399/349 |
| 6,347,212 | B1 | * | 2/2002 | Kosugi et al. | 399/348 |

OTHER PUBLICATIONS

M.A. Biot, *Theory of Propagation of Elastic Waves in a Fluid–Saturated Porous Solid,* Mar. 1956, 168.

M.A. Biot, *Theory of Propagation of Elastic Waves in a Fluid–Saturated Porous Solid,* Mar. 1956, 179.

M.A. Biot, *Mechanics of Deformation and Acoustic Propagation in Porous Media,* Apr. 1962, 1482.

D.L. Johnson, T.J. Plona and H. Kojima, *Probing Porous Media with First and Second Sound. II. Acoustic Properties of Water–Saturated Porous Media,* Mar. 1994, 115.

T.J. Plona, R. D'Angelo and D.L. Johnson, *Velocity and Attentuation of Fast, Shear and Slow Waves in Porous Media,* 1991, 1233–1239.

S. Torquato, *Random Heterogeneous Media: Microstructure and Improved Bounds on Effective Properties,* Feb. 1991, 37.

J.E. White, *Seismic Waves: Radiation, Transmission and Attenuation,* 1965, 70.

W.A. Gray, *The Packing of Solid Particles,* 1968, 34.

* cited by examiner

*Primary Examiner*—Anthony H Nguyen
(74) *Attorney, Agent, or Firm*—Lloyd F. Bean, II

(57) ABSTRACT

An apparatus for removing residual particles from an imaging surface, including: a cleaning blade having an edge adapted to remove the residual particles from the imaging surface; a vibrating member, connected to said cleaning blade, for vibrating said cleaning blade at a predefine frequency to cause stress in contact points between individual residual particles which are in contact with imaging surface thereby improving releasing of residual particles from the imaging surface.

7 Claims, 4 Drawing Sheets

ULTRASONIC CLEANER AND TONER AGGLOMERATE DISPERSER FOR LIQUID INK DEVELOPMENT (LID) SYSTEMS USING SECOND SOUND

BACKGROUND OF THE INVENTION

Cross reference is made to the following applications tiled concurrently herewith: U.S. application Ser. No. 09/699,862 entitled "Method For Improving Oil Recovery Using An Ultrasound Technique", U.S. application Ser. No. 091699, 871 entitled "A Method For Removing Trapped Impurity Aggregates From A Filter", U.S. application Ser. No. 09/699,804 entitled "Method For Dispersing Red And White Blood Cells", U.S. application Ser. No. 09/699,703 entitled "Process and Apparatus for Obtaining Ink Dispersions by Subjecting the Liquid Inks to an Ultrasonic or Sonic Signal", U.S. application Ser. No. 09/699,876 entitled "An Ultrasonic Method For Speeding The Drying Of Fluid Saturated Images In Processes Using Liquid Inks", and U.S. application Ser. No. 09/699,939 entitled "Method For Manufacturing Process".

BACKGROUND AND SUMMARY

The present invention relates to a cleaning apparatus for removing substances from a surface and in particular to a blade cleaning device for use in an image forming device such as an electrostatic copying machine.

References

M. A. Biot, J. Acoust. Soc. Am. 28, 168 (1956).

M. A. Biot, J. Acoust. Soc. Am. 28, 168 (1956).

M. A. Biot, J. Acoust. Soc. Am. 28, 179 (1956).

M. A. Biot, J. Appl. Phys. 33, 1482 (1962).

D. L. Johnson, T. J. Plona, and H. Kojima, J. Appl. Phys. 76(1), 115 (1994).

T. J. Plona, R. D'Angelo, and D. L. Johnson, "Velocity and attenuation of fast, shear, and slow waves in porous media", in *IEEE 1990 Ultrasonics symposium Proceedings*, Vol 3, B. R. McAvoy editor. IEEE, NY. (1991), 1233–1239.

S. Torquato, Appl. Mech. Rev. 44(2), 37 (1991).

J. E. White, *Seimic waves: radiation, transmission, and attenuation*, McGraw-Hill book Company, New York, N.Y., 1965, pg 70.

J. C. Williams, *The packing of solid particles*, Chapman and Hall, Ltd. London, England, 1968, pg. 34.

In an electrophotographic process, such as xerography, an optical device oscillates a light pattern along a charged photosensitive surface to form a latent image corresponding to an electrical or optical input. The resulting pattern of charged and discharged areas on the surface forms an electrostatic latent image corresponding to the original image. Developing devices of the electrostatic copying machine develop the latent image using yellow, magenta, cyan, and/or black developing toners. The developing toners are composed of electrostatically attractable powder and are attracted to the latent image areas formed on the charged photosensitive surface. The developed image is then transferred to a predetermined image medium, e.g., paper, to produce a reproduction and a permanent record of the original image.

When the developed image is transferred onto a paper, a majority of developed toner is transferred to the paper. However, some residual toner remains on the charged photosensitive surface because of the relatively high electrostatic and/or mechanical forces between the electrostatically attracted toner and the charged photosensitive surface. Further, other unwanted substances, e.g., paper fibers, Kaolin, debris, etc., are attracted to the charged photosensitive surface and remain on the charged photosensitive surface. Because the residual toner and unwanted substances left on the charged photosensitive surface will degrade the quality of the reproduced image, it is essential to remove the residual toner and unwanted substances from the charged photosensitive surface during each image development process.

Blade cleaning has been used in cleaning dry toner printer, and is a highly desirable method for removing the residual toner and unwanted substances because it is simple and inexpensive compared to the various known fiber or magnetic brush cleaners. A blade cleaning device comprises a is relatively thin elastomeric cleaning blade member which is provided and supported adjacent to the charged photosensitive surface and is transverse to the charged photosensitive surface relative to the direction of the relative movement. The cleaning blade has a blade edge chiseling or wiping the residual toner from the charged photosensitive surface during the doctoring mode or wiping mode, respectively. Thus, the residual toner and unwanted substances are removed from the surface prior to developing another latent image on the charged photosensitive surface.

The removed residual toner and unwanted substances which accumulate adjacent to the cleaning blade are transported away from the cleaning blade area by a toner transport arrangement or by gravitational force.

In printers which employing liquid developer materials comprising a liquid carrier material having toner particles disperse, it is desirable to remove cake of saturated toner particles off of photoreceptor belts and intermediate belts. Generally, methods consist of a hybrid cleaner wherein a steel blade with auxiliary fluid flush with dispersing agents therein from nozzles to remove agglomerated toner.

It would be highly desirable to have a cleaning system which would not employ dispersing agents thereby toner could be recycled through the printer without adding dispersing agents which might change the properties of the liquid developer.

SUMMARY OF THE INVENTION

In accordance with the present invention, there is provided an apparatus for removing residual particles from an imaging surface, including: cleaning blade having an edge adapted to remove the residual particles from the imaging surface; a vibrating member, connected to said cleaning blade, for vibrating said cleaning blade at a predefine frequency to cause stress in contact points between individual residual particles which are in contact with imaging surface thereby improving releasing of residual particles from the imaging surface.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

Figure 1:
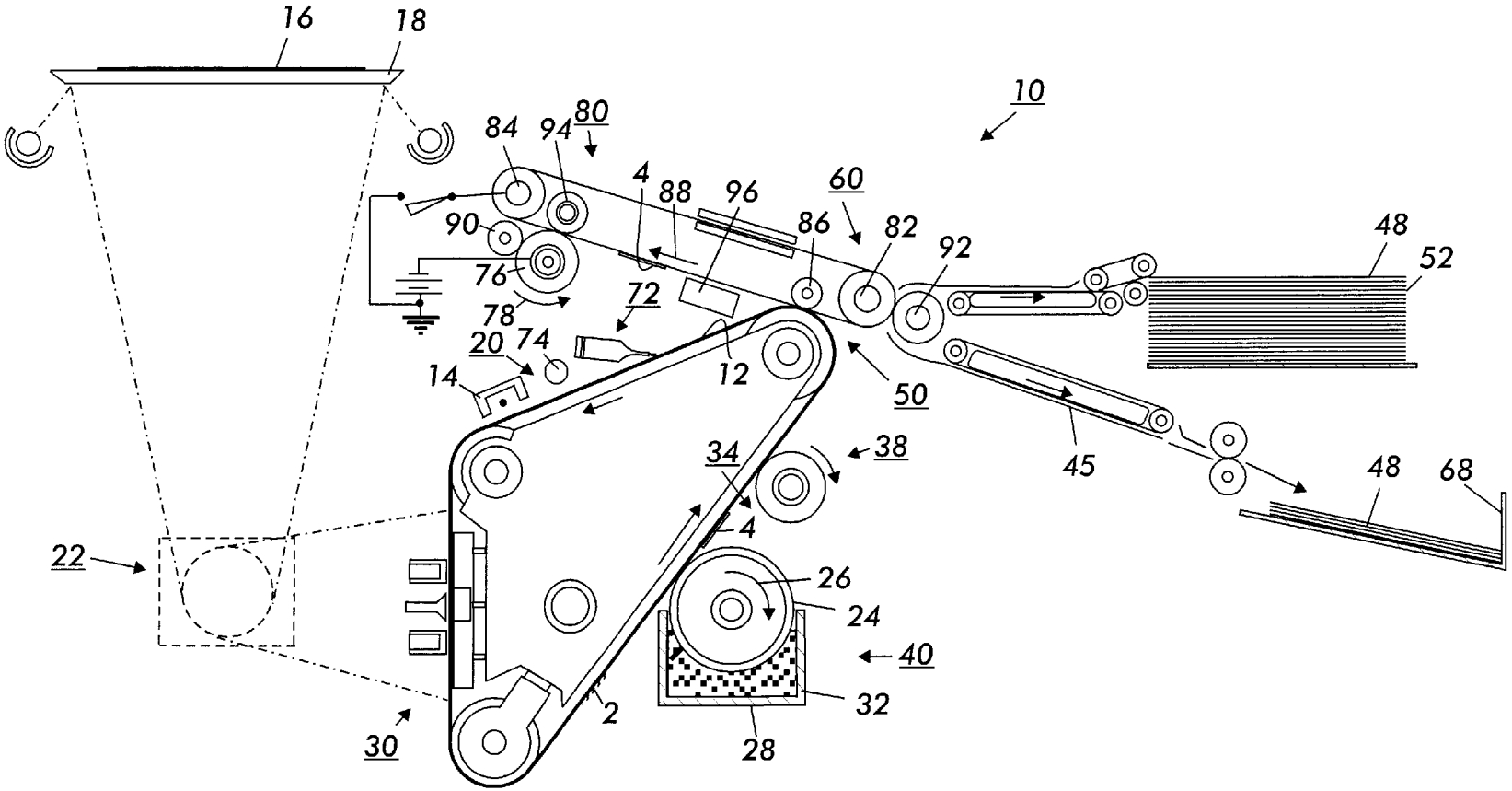
FIG. 1 contains a schematic illustration of a portion of an electrophotographic printing machine which uses an intermediate transfer belt to complete liquid image development.

Referring now to the drawings where the showings are for the purpose of describing an embodiment of the invention and not for limiting the same, in FIG. 1, reproduction machine 10 employs belt 12 having a photoconductive surface deposited on a conductive substrate.

Initially, belt 12 passes through charging station 20. At charging station 20, a corona generating device 14 charges the photoconductive surface of belt 12 to a relatively high, substantially uniform potential. Once the photoconductive surface of belt 12 is charged, the charged portion is advanced to exposure station 30. An original document 16 which is located upon a transparent support platen 18 is illuminated by an illumination assembly, indicated generally by the reference numeral 22, to produce image rays corresponding to the document information areas. The image rays are projected by means of an optical system onto the charged portion of the photoconductive surface. The light image dissipates the charge in selected areas to reveal an electrostatic latent image 2 on the photoconductive surface corresponding to the original document informational areas.

After electrostatic latent image 2 has been revealed, belt 12 advances it to development station 40. At development station 40, roller 24, rotating in the direction of arrow 26, advances a liquid developer material 28 which includes toner particles dispersed substantially throughout a carrier fluid, from the chamber of housing 32 to development zone 34. The toner particles pass by electrophoresis to electrostatic latent image 2. The charge of the toner particles is opposite in polarity to the charge on the photoconductive surface when a CAD system is used, or identical in polarity in the case of a DAD system.

The specific ingredients used to make up the composition of the liquid electrostatic developer are described in U.S. Pat. No. 5,492,788 which is incorporated by reference. The liquid developers suitable for the present invention generally comprise a liquid vehicle, toner particles, and a charge control additive. The liquid medium may be any of several hydrocarbon liquids conventionally employed for liquid development processes, including hydrocarbons, such as high purity alkanes having from about 6 to about 14 carbon atoms, carrier fluids such as Norpar 15® and Isopar L® or Superla® and Isopar L® or a mixture of two or more of the above fluids. The amount of the liquid employed in the developer of the present invention is from about 90 to about 99.9 percent, and preferably from about 95 to about 99 percent by weight of the total developer dispersion. The total solids content of the developers is, for example, 0.1 to 10 percent by weight, preferably 0.3 to 3 percent, and more preferably, 0.5 to 2.0 percent by weight.

Development station 40 includes Low Solids Image Conditioner (LSIC) 38. LSIC 38 encounters the developed image 4 on belt 12 and conditions it by removing and reducing its liquid content, while inhibiting and preventing the removal of solid toner particles. LSIC 38 also conditions the image by electrostatically compacting the toner particles of the image. Thus, an increase in percent solids is achieved in the developed image, thereby improving the quality of the final image.

At transfer station 50, the developed liquid image 4 is electrostatically transferred to an intermediate member or belt indicated by reference numeral 80. Intermediate belt 80 is entrained about spaced rollers 82 and 84. Bias transfer roller 86 imposes intermediate belt 80 against belt 12 to assure image transfer to the intermediate belt 80.

After developed image 4 is transferred to intermediate belt 80, residual liquid developer material remains adhering to the photoconductive surface of belt 12. This material may be removed using cleaning station 72, and any residual charge left on the photoconductive surface may be extinguished by flooding the photoconductive surface with light from lamps 74.

Figure 2:
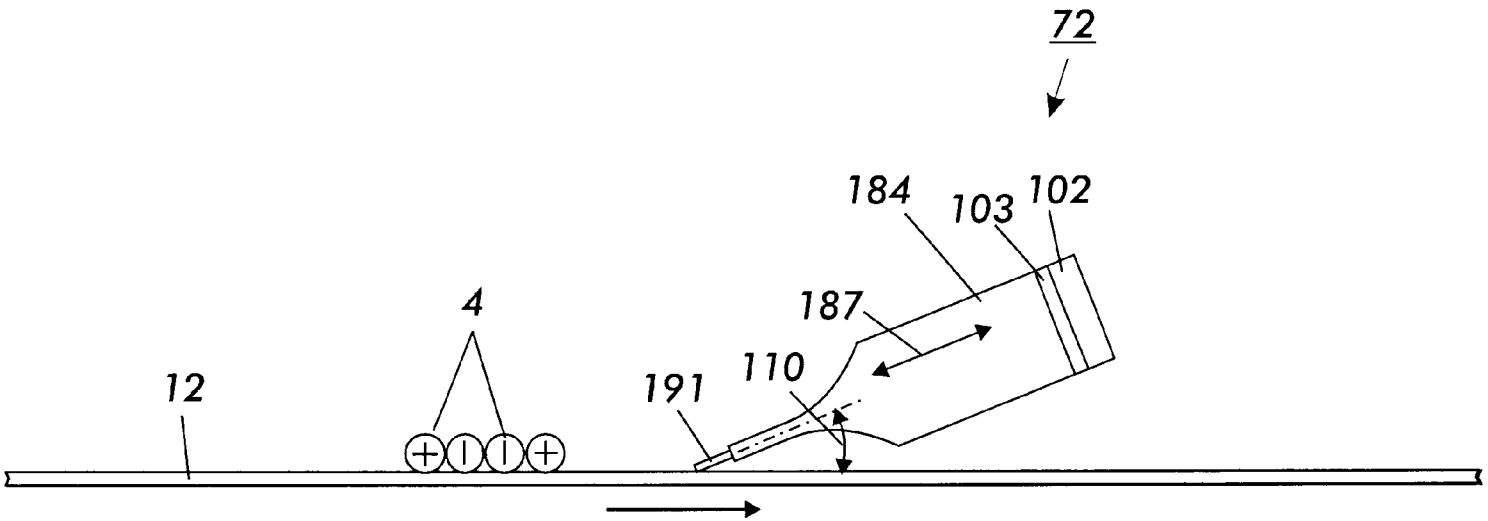
FIG. 2 contains a schematic illustration of an ultrasonic cleaning blade of the present invention.

Referring now to FIG. 2, belt 12 then moves to cleaning station 72, to remove unwanted toner particles. In the present invention, the blade material 191 (such as an elastomer) is attached to the tip of the waveguide 184. The waveguide is attached to the piezoelectric transducer 102 with a bond layer 103 therebetween. The cleaning blade 191 material is an extension of the waveguide 184. When the waveguide 184 is driven at its resonant frequency, the largest vibrations are developed at the cleaning edge of the blade. The structure of the ultrasonic device is used to apply the blade force. The working angle 110 between the cleaning blade 191 and the photoreceptor 10 will vary from about 5 degrees to about 20 degrees. This angle setting depends on the stiffness of the blade 191.

The present invention enhances cleaning by subjecting the image to ultrasonic pressure waves at a specific frequency. Frequency used is the acoustic slow wave frequency which results in the solids and the liquid responding out of phase to each other. Fluid is force through the pore structure of the solid composed of adhered toner particles. For particles directly adhered to belt surface, this fluid motion will tend to place stress on the belt-particle contact points, resulting in release of the toner from the surface.

On intermediate belt 80, the developed image 4 is brought in contact with a High Solid Image Conditioning (HSIC) unit, which further increases the solid particle content of a contacting image. HSIC unit includes backing roll 94, as well as blotter roll 76 and vacuum application system 90.

The HSIC unit conditions developed image 4 on belt 80 by electrostatically compressing it, and additionally reducing its liquid content by removing fluid released by the ultrasonic frequency generated by piezoelectric horn 200, while preventing toner particles from departing from the image.

Blotter roll 76 and vacuum application system 90 remove carrier fluid from the surface of developed image 4 and transport it out of reproduction machine 10 for recycling or for collection and removal. More specifically belt 80, supported by backing roll 94 on its inside surface, transports developed image 4 past the HSIC unit. Blotter roll 76 is brought in contact with developed image 4 directly across from backing roll 94, causing carrier fluid to be absorbed from the surface of belt 80. Vacuum application system 90 then draws carrier fluid from blotter roll 76 and transports it away from the imaging system.

After vacuum system 90 removes fluid from blotter roll 76, the fluid is transported out of the reproduction machine for recycling or removal. Roll 76 continues to rotate past subsequent developed images 4. This provides for a continuous absorption of liquid from the surface of developed image 4 as blotter roll 76 is discharged of excess liquid due to its communication with vacuum system 90.

Belt 80 then advances the developed image to transfer/fusing station 60. At transfer/fusing station 60, a copy sheet 48 is advanced from stack 52 by a sheet transport mechanism, indicated generally by the reference numeral 54. Developed image 4 on the surface of belt 80 is attracted to copy sheet 48, and is simultaneously heated and fused to the sheet by heat from roller 82, for example. After transfer, conveyor belt 45 moves the copy sheet 48 to the discharge output tray 68.

The present invention enhances cleaning by tailoring the ultrasonic frequency specifically to the nature of the particle and fluid to be removed. As discussed in more detail below, interior fluid motion is enhanced to the greatest extent possible by utilizing ultrasonic waves at or near a specific frequency called the acoustic slow wave frequency. At this point fluid is forced to move through the pore spaces and necks within each individual particle. This fluid motion exerts viscous drag forces on the particles, especially in the region of particle-particle and particle-belt (or other substrate) contact points. Thus, these forces act over an entirely different distance range, and via a different mechanism, than the forces acting between pressure maxima and minima in an ultrasonic wave. The acoustic slow wave method of the present invention makes use of the realization that the propagation of sound through porous media containing a viscous fluid has different modes of motion which may be excited at different frequencies.

The frequency of the ultrasound is set by of knowing the following information: the particle size, some notion of their packing fraction (or percent solids), and the viscosity and density of the pore fluids. From this information, as discussed below, we can estimate the acoustic slow wave frequency, i.e., the frequency that we want to apply to the suspension of fluid and fluid-saturated aggregates as (White, 1965):

$$f_c=\eta\phi/(2\pi k\ \rho f) \quad (1)$$

where $\eta$ is the fluid viscosity, $\phi$ is the particles porosity, k is the particle agglomerate permeability, and $\rho_f$ is the fluid density.

Figure 3:
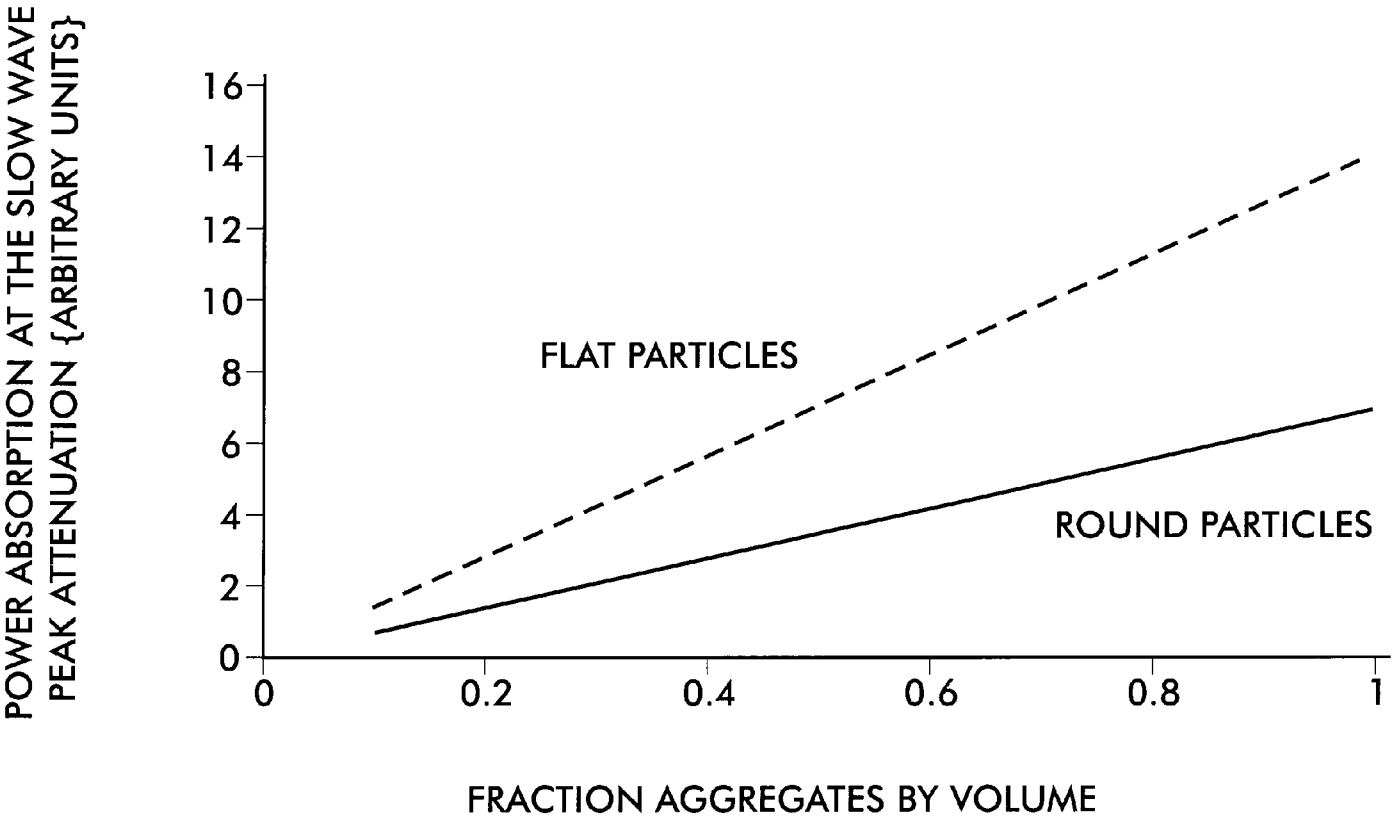
FIG. 3 illustrates the power absorption at the peak of the power absorption frequency spectrum (i.e., the slow wave frequency) is proportional to the concentration of aggregates in the sample.

As shown in FIG. 3, the power absorption at the peak of the power absorption frequency spectrum (i.e., the slow wave frequency) is proportional to the concentration of aggregates in the sample. This power absorption is almost entirely due to slow wave excitation in aggregates when the applied frequency of the ultrasonic waves is near to the slow wave frequency. Power absorption by normal sound excitation is smaller by 1–2 orders of magnitude near the slow wave frequency. Also noted in FIG. 3 is the dependence of the power absorption-concentration curve on the shape of the pores in the aggregate. For pores between spherical particles the slope of the curve is lower than for pores between long flat particles. Thus, there is some degree of experimental calibration through the use of microscopically characterized samples that must be done if there is a distribution of particle shapes and sizes. Such calibration techniques are well known to those skilled in the art.

Figure 4:
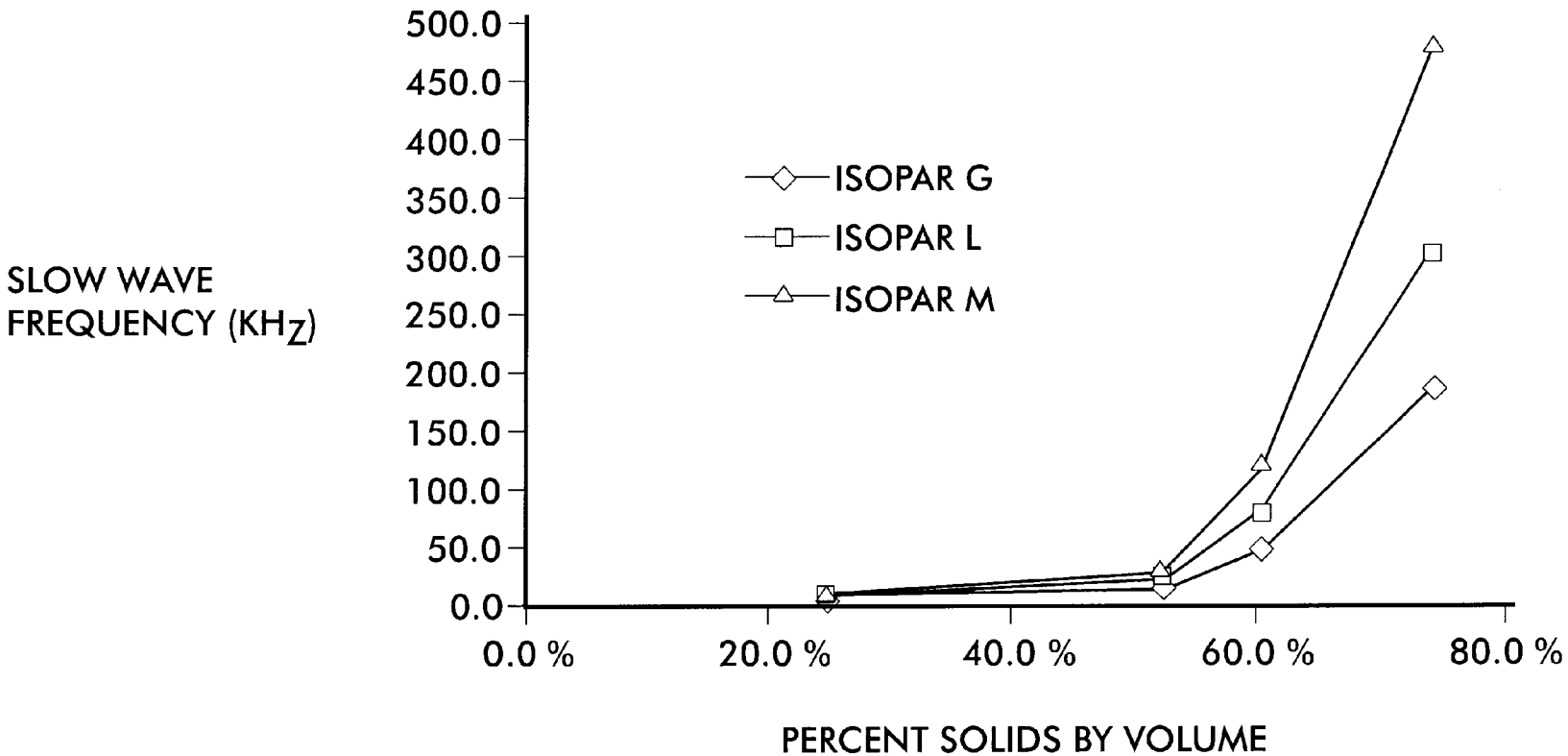
FIG. 4 illustrates typical acoustic slow wave frequencies for aggregates composed of 2-micron particles in Isopar G, L, and M.

Typical acoustic slow wave frequencies are shown in FIG. 4 for aggregates composed of 2-micron particles in Isopar G, L, and M. As indicated in FIG. 4, as the percent solids in an aggregate decreases with breakup, the acoustic slow wave frequency that will have the maximum disruptive effect on the aggregate decreases.

In order to maintain the effectiveness of the ultrasonic vibration throughout its excitation of an aggregate, the frequency of the driving source must either (1) change with time, or preferably, (2) contain all of the appropriate frequencies at all times. Both frequency signatures are possible and potentially useful, and hence offer different embodiments of the invention. Thus, as indicated by FIG. 4, to track the complete breakup of an aggregate that starts at about 60% solids concentration, the source should be "white" over a frequency range of approximately 10–60 kHz (for an isopar L pore fluid and 2 micron toner particles).

Having in mind the main elements of the present invention, and not wanting to be limited to theory, the present invention is believed to operate as follows: When a solid containing a fluid is subject to a sound wave, the fluid and the liquid will oscillate in the direction of propagation of the sound wave. In general, the fluid and the porous solid respond at slightly different rates. In the limit of very low frequency the porous solid and the liquid will respond completely in phase, resulting in no net motion of the fluid with respect to the porous solid. In this limit, as discussed in the paragraph above, forces within the fluid-saturated solid occur between the maximum and minimum pressure positions within the solid, located ½ wavelength apart. Since a single particle agglomerate is small compared to the size of the wavelength of the sound wave, the pressure differences within a single agglomerate are small, resulting in small forces acting to break up the particle.

As the frequency of the driving sound wave increases, the viscous fluid motion lags slightly behind that of the approximately rigid solid. This results in fluid motion through pores in the particulate solid, which in turn induces stresses on the particle-particle contact points.

As the frequency increases, the phase lag in relative motion between the solid and liquid also increases, at least up to a point. At a point called the acoustic slow wave point the motion of the solid and liquid will be 180 degrees out of phase. At this point we have the maximum amount of motion of the fluid with respect to the aggregated solid. This results in the maximum viscous stress on the adhesive bonds holding adhered particles to the belt, and holding particles together. If these viscous shearing forces exceed the shear strength of the adhesive bonds between particles, the aggregate will start to fall apart. Now, however, these forces tending to destroy the aggregate will occur on the interparticle length scale, not on a scale of ½ the wavelength of the sound wave in the composite fluid. Thus, the ultrasonic wave at the correct slow wave frequency will act not only to break the adhesive bonds holding particles to the substrate, but will also act to break up aggregates virtually down to the level of single or a few particles. This has the effect of redispersing the particles in liquid ink, if used with a fluid wash, without the necessity of chemical dispersing agents, which change the chemical and physical properties of the ink.

The first analysis of these different modes of fluid motion was carried out by Biot (1956a,b; 1962), and has been a topic of continuing research [see Johnson, Plona, and Kojima (1994) and references cited therein]. The acoustic slow wave mode is also sometimes called the "compressional slow wave" or just the "slow wave". These waves have been observed experimentally in a variety of porous solids, and are well-verified (Johnson, et. al., 1994).

The frequency of the acoustic slow wave mode, $f_c$, in an infinite porous solid is given by (White, 1965):

$$f_c=\eta\phi/(2\pi k\ \rho_f) \quad (1)$$

where $\eta$ is the fluid viscosity, $\phi$ is the aggregate porosity, k is the aggregate permeability, and $\rho_f$ is the fluid density. $\phi$ depends on the volume fraction of solids in the aggregate particle via:

$$\phi=1-(\%S/100) \quad (2)$$

where %S is the percent of solids in the aggregate, by volume. This expression can be easily converted to reflect porosity in terms of %S by weight.

It is obviously impossible (or at least very difficult) to directly measure the permeability of a single particle aggregate. Therefore it is preferable to predict the aggregate permeability. There are several ways in which this can be done. Variational bounds giving the upper and lower limits have been put on the permeability of particle composites [see e.g., Torquato (1991), and references cited therein]. There are also phenomenological relationships between the permeability and related quantities such as aggregate porosity. For this analysis we make use of the Carmen-Kozeny equation (see Williams, 1968, and references cited therein), which has the advantage of being a physically plausible form suggested by physical arguments, with a phenomenologically determined prefactor:

$$k=B\phi^3/\{S_v^2(1-\phi)^2\} \quad (3)$$

where B is a constant, typically on the order of 5, and $S_v$ is the particle surface area per unit volume within the aggregate. $S_v$ will depend on the particle size and packing of the particles, and is inversely proportional to particle diameter (Williams, 1968). Several specific particle packings have been used to calculate both $S_v$ (for use in Equations(1)–(3)) and %S in FIGS. (2) and (3), using information on the packings provided in Williams (1968). For example, for cubic close packing of particles, the porosity $\phi=0.476$, and $S_v=\pi/D$, where D is the particle diameter. For body centered cubic packing the porosity $\phi=0.395$, and $S_v$32 $2\pi/D$. For face centered cubic packing the porosity $\phi=0.26$, and $S_v=4\pi/D$. For random packing the porosity $\phi=0.63$, and $S_v=7\pi/D$. This information on $S_v$, plus Equations (2)–(3) allow the compressional slow wave frequency to be estimated by Eq.(1). This information on $S_v$, plus Equations (1) and (3) allow the compressional slow wave frequency to be estimated by:

$$f_c=\eta\{S_v^2(1-\phi)^2\}/(2\pi B\phi^2\rho_f) \quad (4)$$

Useful compressional slow wave frequency can be in the range between ±15% of the calculated or measured peak slow wave frequency While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for removing residual liquid developer materials comprising a liquid carrier material having toner particles dispersed therein from an imaging surface, comprising:

a cleaning blade having an edge adapted to remove the residual toner particles from the imaging surface;

a vibrating member, connected to said cleaning blade, for vibrating said cleaning blade at a predefined frequency, said predefined frequency consisting an acoustic slow wave frequency being determined by a function of the properties of said residual toner particles and liquid carrier on the imaging surface where upon application of said acoustic slow wave frequency induces fluid motion of the liquid carrier within residual toner particles to generate stress in contact points between individual residual toner particles which are in contact with imaging surface thereby improving releasing of residual particles from the imaging surface.

2. The apparatus of claim 1, wherein said cleaning blade is rigid.

3. The apparatus of claim 2, wherein said blade is composed of metal.

4. The apparatus of claim 2, wherein said vibrating member includes a piezoelectric element.

5. The apparatus of claim 2, wherein said blade vibrating at the acoustic slow wave frequency redisperses toner particles for reuse as ink without the use of chemical dispersing agents.

6. The apparatus of claim 1, wherein is said acoustic slow wave frequency determine by the following equation:

$$f_c=\eta\{S_v^2(1-\phi)^2\}/(2\pi B\phi^2\rho_f)$$

where $f^c$ is the acoustic slow wave frequency, $\eta$ is the fluid viscosity, $S_v$ the primary particle surface area per unit volume of the aggregate, $\phi$ the aggregate porosity, $\rho_f$ is the fluid density, and B is a phenomenologial constant.

7. The apparatus of claim 6, wherein the ultrasonic frequency is about −15% to +15% of $f_c$.

* * * * *